US011492800B2

(12) United States Patent
Smith

(10) Patent No.: US 11,492,800 B2
(45) Date of Patent: Nov. 8, 2022

(54) BUILDING PANEL FIRE BLOCKING SYSTEM

(71) Applicant: Ashley Smith, Midland, VA (US)

(72) Inventor: Ashley Smith, Midland, VA (US)

(73) Assignee: EASI-SET WORLDWIDE, Midland, VA (US)

( * ) Notice: Subject to any disclaimer, the term of this patent is extended or adjusted under 35 U.S.C. 154(b) by 0 days.

(21) Appl. No.: 17/153,328

(22) Filed: Jan. 20, 2021

(65) Prior Publication Data

US 2022/0228363 A1 Jul. 21, 2022

(51) Int. Cl.
*E04B 1/94* (2006.01)
*E04B 1/00* (2006.01)

(52) U.S. Cl.
CPC ..... *E04B 1/948* (2013.01)

(58) Field of Classification Search
CPC ..... E04B 1/948
USPC ..... 52/317
See application file for complete search history.

(56) References Cited

U.S. PATENT DOCUMENTS 4,127,353 A * 11/1978 Busse ..... F16B 12/2054 403/245
4,133,156 A * 1/1979 Unger ..... B28B 23/028 52/383
4,276,332 A * 6/1981 Castle ..... A62C 3/16 138/149
4,411,118 A * 10/1983 Claver ..... E04C 2/296 52/582.2
5,189,857 A * 3/1993 Herren ..... E04B 2/58 52/317
6,260,318 B1 * 7/2001 Herren ..... E04B 2/7453 52/317
6,374,558 B1 * 4/2002 Surowiecki ..... E04B 2/7457 52/241
6,824,887 B2 * 11/2004 Ragland ..... B65D 73/0057 428/573
7,200,973 B2 * 4/2007 Tunis ..... B32B 15/02 52/165
8,215,079 B2 * 7/2012 Sinclair ..... E04B 2/10 52/DIG. 9
8,341,902 B2 * 1/2013 Kusuma ..... E04C 3/20 52/236.3

(Continued)

FOREIGN PATENT DOCUMENTS

FR 2647835 A1 * 12/1990
FR 2979363 A1 * 3/2013 ..... E04B 1/34373

(Continued)

*Primary Examiner* — Brian D Mattei
*Assistant Examiner* — Joseph J. Sadlon
(74) *Attorney, Agent, or Firm* — WCF IP

(57) ABSTRACT

A fire blocking system for building panels includes a fireproof block held in place between two beams or studs on opposing fastener members. The fireproof block is preferably held adjacent a slab or other structure, and is preferably of the same thickness. Thus, fire and smoke is prevented from or at least delayed from passing from one side of the structure to the other through the building panel (e.g., from passing from one floor to the next). The fire blocking system reduces the use of fire proofing materials required for building panels, while simultaneously improving the fire blocking capabilities of the building panels to meet building codes for fire resistance.

12 Claims, 5 Drawing Sheets

(56) References Cited

U.S. PATENT DOCUMENTS

| | | | | |
|---|---|---|---|---|
| 8,528,297 | B2 * | 9/2013 | Ceccotti | E04B 1/04 52/745.13 |
| 9,151,045 | B2 * | 10/2015 | Huang | E04B 2/7401 |
| 9,404,251 | B2 * | 8/2016 | Reichinger | F16L 5/025 |
| 10,245,755 | B2 * | 4/2019 | Yu | E04C 2/04 |
| 10,392,800 | B1 * | 8/2019 | Shin | E04B 1/04 |
| 2003/0091384 | A1 * | 5/2003 | Jo | E04B 2/7448 403/350 |
| 2007/0175114 | A1 * | 8/2007 | Price | E04F 13/0803 52/169.12 |

FOREIGN PATENT DOCUMENTS

| | | | | |
|---|---|---|---|---|
| GB | 331001 A * | 6/1930 | | E04B 1/944 |
| WO | WO-2018137743 A1 * | 8/2018 | | E04B 2/707 |

* cited by examiner

BUILDING PANEL FIRE BLOCKING SYSTEM

FIELD OF THE INVENTION

The disclosure generally pertains to a fire blocking system in a building panel and a method to utilize such system to block and/or reduce the spread of fire in a building structure through prefabricated building panels (sometimes referred to as "fireproofing").

BACKGROUND

Building construction panels for walled external and surface structures, either prefabricated with embedded metal frames or cast-in-place concrete building panels, are manufactured with a wide array of materials and techniques. Since the resistance of the building to fire is directly related to the material used in the building structure and construction panels, many efforts were made to improve fire-rated wall construction components and assemblies. In the case of building panels with metal frames, model building codes require certain building elements to meet a specific fire resistance rating.

Current strategies of fireproofing buildings generally involve two approaches. One is to modify the composition of insulating materials in the panel by including flame retardant additives or inorganic additives or both. Another method is to coat or layer the building panels with fire-resistance materials or additional panels. One example of a fire resistant construction panel is disclosed in U.S. Pat. No. 4,028,854 (Diggs); a fireproof modular building with a frame comprising prefabricated non-flammable tubular wall columns adapted for circulating the non-flammable fluid. U.S. Pat. No. 5,167,098 (Blackwelder) discloses a fire-resistant building system that comprises stacked sheets of gypsum type board and overlapping metal sheets. U.S. Pat. No. 6,755,907 by Westerman, et al., which describes a gypsum composition made with a styrene butadiene latex additive and methods of manufacturing wallboard for improved properties. Such strategies, however, do not provide solutions for some known concerns; e.g. high cost due to increased installation time and materials, potential detachment of layered panels or plates, and reduced structural strength of the panels that is caused by altering panel density and integrity.

There is a need in the art for an improved fire blocking method for building panels and more specifically to block the spread of fire in a building while providing good mechanical strength and high fire resistance in the most cost- and space-efficient manner.

SUMMARY OF THE INVENTION

The fire blocking system, according to some embodiments of the disclosure, comprises a block of fireproofing material that is mechanically connected through fasteners (sometimes referred to as "anchors") that are welded on studs or beams that may be further integrated into various construction components, e.g., building panels, either in prefabricated or cast-in-place form. The block of fireproofing material will be secured by sliding slots on its first and second ends onto fasteners on adjacent studs at a level that is adjacent to a slab (ceiling and/or floor), and will preferably be the same thickness as the slab (ceiling and/or floor). Thus, the fireproofing system will block fire from jumping from one floor to the next through the building panel, and/or reduce the spread of fire to a level which satisfies fire codes. The fire blocking system eliminates the necessity of outer-panel coating and layering to comply with building regulation for fire resistance. In addition, the block of fireproofing material provides structural rigidity in a cost and space efficient manner. The fire blocking system may be pre-assembled in the building panel before the building panel is brought to a job site, or may be assembled at the job site. For assembly at a job site, blocks of fireproofing material of different thicknesses may be used to accommodate different thicknesses of slabs. Alternatively, if the block of fireproofing material is not thick enough and/or does not have a top which extends the full thickness of the slab, mineral wool and/or other fire proofing material can be placed on top of the block to fill the space between the studs which is adjacent the slab.

One aspect of the disclosure provides a fire blocking system comprising at least one block of fireproofing material, two studs or beams, and at least two fasteners that are welded or weldable to the studs or beams. In some embodiments, a block of fireproofing material may be fitted into a space between two studs; which are positioned so that each stud is facing another stud. In each stud, a welded or weldable or otherwise fixable fastener may be situated on the side that faces the other stud. In assembly of the fire blocking system, the fasteners on adjacent studs may be inserted into open slots of the fireproofing block to firmly secure the block in the space between the studs. The studs of the building panel will be perpendicular to the slab of the building and the fire blocking system will serve to prevent or reduce the spread of fire from one floor to another through the building panel. In preferred embodiments, the thickness of the fireproofing block is equivalent to the thickness of the slab at the base of a building or the slab that functions as the ceiling of one floor and base of a higher floor. However, in some embodiments, a volume between the first and second studs, an intersecting edge of a floor slab, and a block of fireproofing material, may also be filled with additional fireproofing materials such as mineral wool in cases where the fireproofing block does not extend for the full thickness of the slab.

In multi floor buildings, building panels with the fire blocking system of this invention will be positioned to extend from one floor to the next, and there will be a fire blocking system at each slab so that fire does not rapidly spread from floor to floor through the building panels.

In some embodiments, the fireproofing block is secured to the opposing fasteners on adjacent studs by sliding it in a downward direction between the studs and over outwardly extended heads of the fasteners. The fireproofing block will have outward opening slots on each of its longitudinal ends that extend from the bottom of the block to the middle of the block. The slots may taper from the bottom end of the block towards the top of each slot in the middle of the block so that the fireproofing block is more securely held as it is pushed downwardly on the heads of the fasteners, i.e., the farther down it is pushed the more tightly the block is gripped by the fastener heads wedging into the slots so that after installation the block will not be easily dislodged. The fireproofing block itself will be sufficiently stiff that it will improve the structural rigidity of the building panel once installed between adjacent studs.

Additional features and advantages of the present invention will be set forth in the description of disclosure that follows, and in part will be apparent from the description or may be learned by practice of the disclosure. The disclosure will be realized and attained by the compositions and methods particularly pointed out in the written description and claims hereof.

DETAILED DESCRIPTION

The preferred embodiments of the present disclosure are directed toward a fire blocking system for use in building panels, as well as to methods of utilizing the fire blocking system in building panels installed on multi-floored buildings. The fire blocking system functions to block and/or reduce the passage of fire between floors of a building through the building panel assembly. That is, the fire blocking systems described herein will substantially block the path of fire, heat, or smoke from leaving one portion of a building to another portion of the building through the building panels. The fire blocking system is cost and space efficient, and may be installed in prefabricated building panels at a factory, and or may be installed in building panels at a work site.

In exemplary embodiments, the fire blocking system is especially useful when the system is embedded within a prefabricated building panel. As used herein, the term "building panel", is a broad term, and is used in accordance with its ordinary meaning. The term may include, but is not limited to vertical walls, ceilings, floors, interior walls, exterior walls, prefabricated panels or walls, and cast-in-place panels or walls. It is an object of the disclosure to provide wall components for the present invention to be positioned within. To achieve some or all of these objects, an embodiment of a fire blocking system is provided that includes three separate components which includes two fasteners which are affixed to two adjacent studs or beams, and a structurally rigid block comprising fireproofing materials which can be held between to the two fasteners. Preferably, the fireproof block is of a thickness equivalent to a slab (floor and/or ceiling) in the building and is held in place between the adjacent studs at a level that has the fireproof block adjacent to the slab. Thus, a fire in a lower floor cannot easily pass through the building panel to a higher floor, as it will be blocked by the fireproof block held in place at the slab by the opposing two fasteners.

Figure 1B:
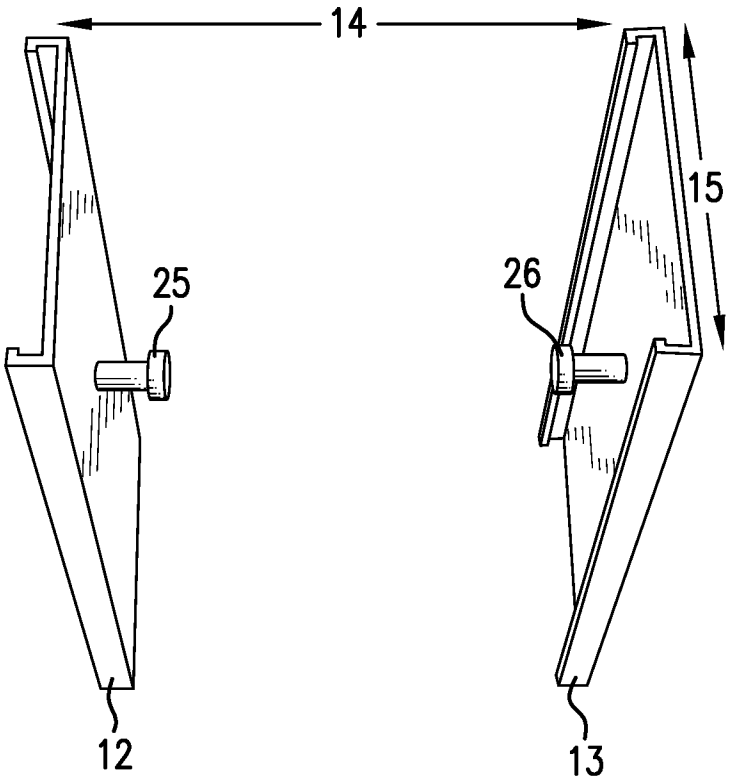
FIG. 1A-B. (A) illustrates a perspective view of an embodiment of a fastener welded or otherwise secured on a stud element. (B) illustrates a perspective view of two adjacent studs with fasteners facing one another, such as would be the case with prefabricated and/or build in place building panels.
Figure 1A:
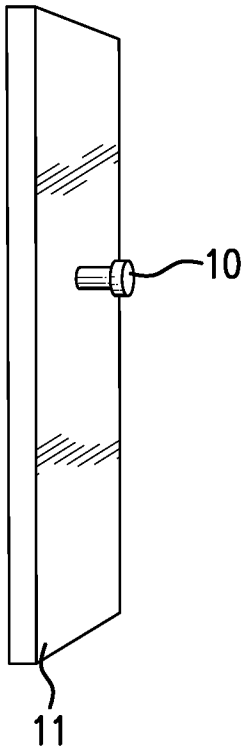

With reference to FIG. 1A, in some embodiments, a fastener (or "anchor') 10 is attached (preferably welded) to a stud 11. In exemplary embodiments, fasteners with a size of about at least ¼ to ⅝ inches in diameter are used and individual fasteners may be assembled by, for example, a stud arc welding process. The fasteners used are akin to the plurality of headed studs or bolts that are normally used in building construction to secure and connect structural or non-structural elements to studs or beams. In some exemplary embodiments, the headed fasteners are ⅜ inches in diameter. In some embodiments, the fastener are "Nelson" headed fasteners. The fastener 10 may also be permanently secured to studs by known methods in the art such as welding. The most commonly used fasteners in building panels include regular or stainless steel fasteners.

Figure 3B:
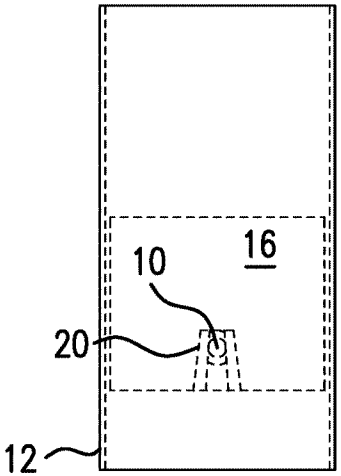
FIG. 3A-D. (A) is a perspective profile view of an embodiment of a fire blocking system. (B) is a cross-sectional view of an embodiment of a fire blocking system. (C) is a perspective view of an embodiment of a fire blocking system adjacent to a slab (ceiling and/or floor). (D) is another perspective view of an embodiment of a fire blocking system that is positioned slightly below a ceiling and/or does not have a thickness which matches the thickness of the ceiling.
Figure 3D:
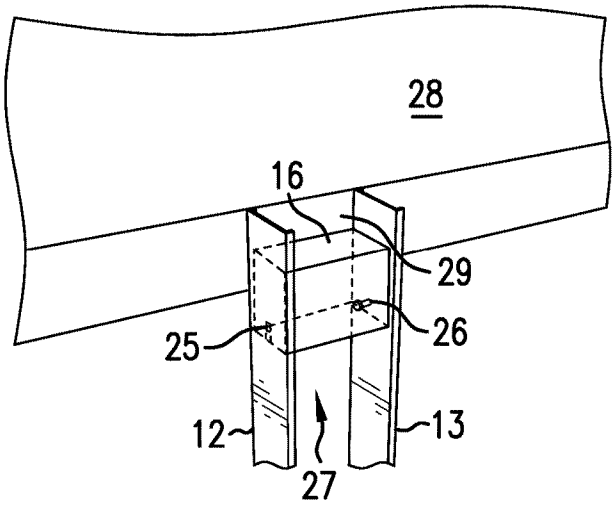
Figure 3C:
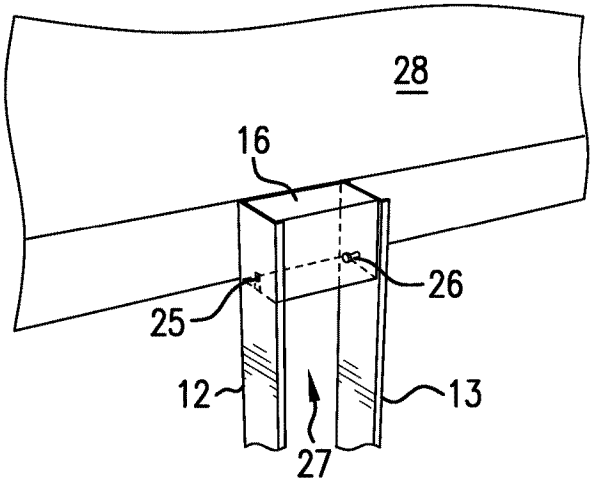
Figure 4A:
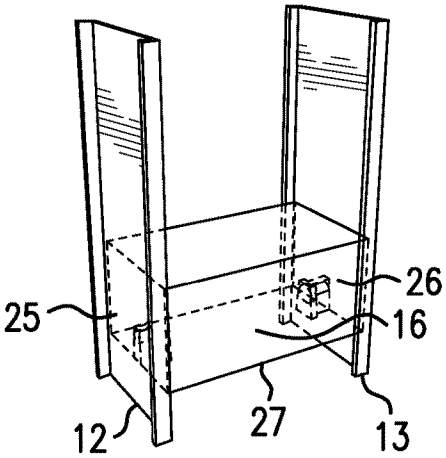
FIG. 4A-C. (A) is a perspective profile view of an embodiment of a fire blocking system with a block of fireproofing material assembled near the bottom of studs. (B) is a perspective view of an embodiment of the fire blocking system adjacent to a floor slab. (C) is another perspective view of an embodiment of a fire blocking system that is positioned slightly above the floor slab and/or does not have a thickness which matches the thickness of the floor slab.
Figure 4B:
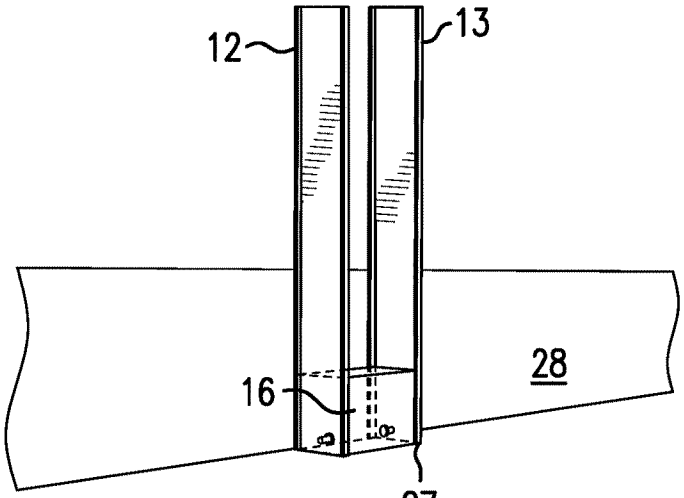

In some exemplary embodiments, as shown in FIG. 1B, two adjacent studs or beams 12 and 13 in a building panel, are positioned so that the fasteners 25 and 26 extend from each stud and oppose one another. The studs or beams 12 and 13 may be G90 galvanized steel studs or similar supporting members that meet the same or better structural integrity. C-shaped studs or beams are well suited for this application, but other alternatives supplying the same supportive functionality may occur to those of skill in the art and are likewise employable in the practice of the invention. In a building panel, there is a plurality of parallel beams or studs which may be spaced apart by spacing a first stud 12 and a second stud 13 at least as large as 4 feet. For example, the spacing 14 of first 12 and second 13 studs may equal or exceed 2 feet, 2.5 feet, 3 feet, 3.5 feet, up to at least 4 feet. Spacing of studs is fixed and maintained by a plurality of assembly methods; e.g. permanently securing studs to a frame, a concrete slab, a floor slab, a ceiling or outer anchors, etc. The width 15 of said plurality of studs or beams may vary and may be 3, 4, 5 or 6 inches or more. The studs or beams may be positioned perpendicular to a slab (ceiling and/or floor) when the building panels placed or assembled adjacent to the slab. As is best shown in FIGS. 3C and 4B, in the preferred embodiment, the opposing fasteners 25 and 26 are positioned such that the fireproofing block 16 is held in the volume defined by studs or beams 12 and 13 and slab (ceiling and/or floor) 28. Preferably, the thickness of the fireproofing block 16 matches the thickness of the slab 28. Thus, for example, fire in a lower floor, will be prevented from or at least its speed will be reduced from passing from the lower floor to the upper floor by the block 16 (i.e., the fire blocking system of the two fasteners 25 and 26 and the block 16).

Figure 2B:
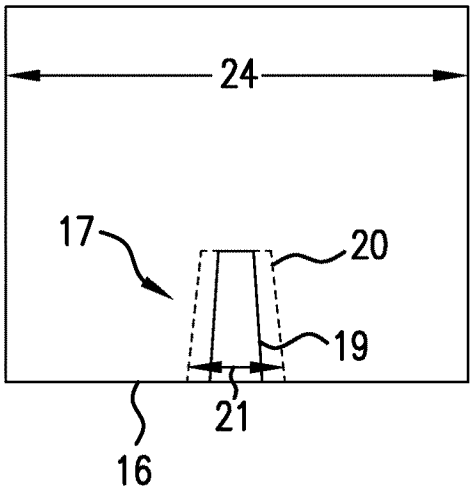
FIG. 2A-C. (A) is a perspective view of an embodiment of a block of fireproofing material. (B) is a cross-sectional view of a block of fireproofing material. (C) is a plan view of the block of fireproofing material showing the slots within the block located at each end of the block.
Figure 2A:
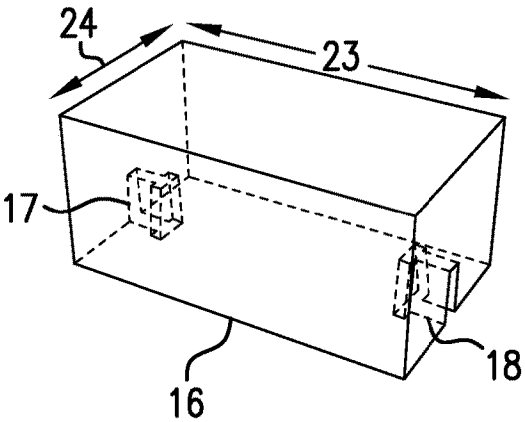
Figure 2C:
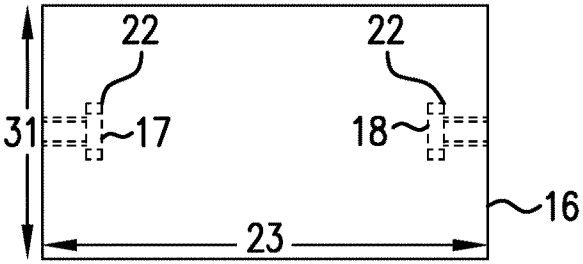

A perspective view of an embodiment of a block of fireproofing material 16 is shown in FIG. 2A-C. By "block", it is meant that one or a plurality of fireproofing materials, which can be in the form of a single or mixture of compositions, is in the form of a solid piece with some degree of rigidity. The SoftSound® product available from Easi-Set Worldwide of Catlett, Va. may be used as the block 16 and is an open cell, free draining material which includes mineralized wood chips as the aggregate. The block 16 may include, for example, gypsum, perlite, proplex, calcium or sodium silicates, treated fibers, treated lumber, intumescent materials, mineralized wood chips (e.g., SoftSound®), and glass. The block 16 may be comprised of any other fire-resistance materials treated with fire resistance (FR) chemicals or compounds. Examples of FR chemicals/compounds include, but are not limited to, phosphoric acid and its derivatives, phosphonic acid and its derivatives, sulfuric acid and its derivatives, sulfamic acid and its derivatives, boric acid, ammonium phosphates, ammonium polyphosphates, ammonium sulfate, ammonium sulfamate, ammonium chloride, ammonium bromide. The block 16 should be of thickness so as to provide sufficient fire resistance as is needed in a building, and, as noted above is preferably of the same thickness as the slab between upper and lower floors in a building. In a preferred embodiment, the block 16 may be made from SoftSound® (Easi-Set Worldwide). In some embodiments, the block 16 provides fire resistance for at least or up to 1, 2, 3, 4, 5, 6, 7, 8, 9, or 10 hours or more.

As is shown in FIGS. 2A-C, the block 16 has two slots 17 and 18 at each end. The slots 17 and 18 are open at the bottom of the block. Both slots 17 and 18 may narrow in a vertical upward direction so that the outer opening 19 of a slot is wider than the inner part 20 of the slot (FIG. 2B). In at least some embodiments, the width 21 of an outer opening slot 17 or 18 of the block may be about ½ inch or more, the chief requirement being that the head of the fasteners 25 and 26 can fit in the opening and, when the block 16 is pressed downward, the heads of the fasteners slide up and wedge deeper into the slots 17 and 18. In some embodiments, the top inner corner parts 22 of the slots may contain grooves that snuggly fit around the heads of the fasteners (FIG. 2C). Geometrically, the length 23 of the fireproofing block 16 may be identical to the space between the first 12 and second 13 studs, while the width 24 of the block 16 may match the width 15 of the first 12 and second 13 studs. The height 31 of the block 16 may be 2, 3, 4, 5, 6, 7, 8, 9, 10, 11, or 12 inches or more. As noted above, the height 31 is preferably the same as the thickness of a slab 28 or whatever structure the end of the studs 12 and 13 will be placed perpendicularly against when the building panel is installed.

Figure 3A:
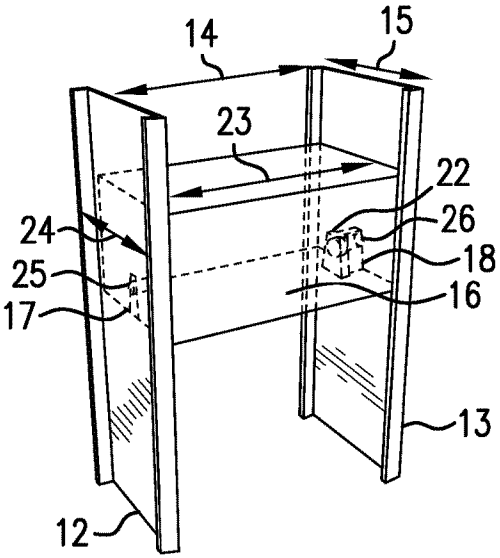

In some embodiments, the block 16 of fireproofing material, two anchors, and two studs, are assembled as shown in FIG. 3A. This can be done at a factory when the building panel is fabricated, or it can be done at a construction site by slipping the block 16 of fire proofing material onto the opposing fasteners 25 and 26 when the building panel is being installed In this embodiment, the block of fireproofing material 16 may slide downward between the first 12 and second 13 studs, over the first 25 and second 26 fasteners that are attached thereto. This is done by passing the heads of the fasteners 25 and 26 through the first 17 and second 18 slots at the longitudinal ends of the block 16. In this case, the block may have the identical length 23 of which spans the space 14 between the first 12 and second 13 studs and width 24 of the block may be identical to the width 15 of studs. As shown in FIGS. 2A-2C and 3A-D, the slots 17 and 18 in the bottom of block 16 may larger than the fasteners 25 and 26 at the bottom of the block 16. However, as the block 16 is pushed downward, in preferred embodiments, the slots are tapered such that the slot 20 is reduced to the same size or possibly slightly smaller than the fasteners 25 and 26 (FIG. 3B). In this way, the wedge created provides for a tight fit for the block 16 between the studs 12 and 13 which will resist popping out of place during construction, during a fire, or due to other forces which may be applied to the building panel during use. In some embodiments, the slots 20 and fasteners 25 and 26 may further be affixed by applying epoxy or other types of materials to glue the two components in position. In yet another embodiment, the block may be installed during or after the manufacture of a prefabricated building panel. The block may be pre-assembled at an off-site manufacturing facility or assembled at a building construction site, depending on the particular application and project requirements. The slide-and-affix method allows for easy installation and handling for manufacturing, stripping, and transporting of the system.

FIGS. 3C-D and 4B-C show that the fire blocking system 27 can be positioned at a variety of different positions and/or ranges of positions with respect to the length of the studs. In most applications, it is envisioned that the fire blocking system 27 will be positioned adjacent a structure such as the slab of a building, wall, etc., where the fire blocking system 27 functions to stop fire from passing through the building panel from one side of the structure to the other (e.g., from one floor to the next). For ease in discussion, the fire blocking system 27 will be discussed in terms of its function with respect to the slab (ceiling and/or floor) of a building; however, other configurations are possible where the fireproof block 16 of the blocking system 27 is held between studs on opposing fastener elements and adjacent to other building structures besides slabs.

In the preferred embodiment, the fire blocking system 27 is either flush with the slab 28 that serves as the ceiling of one level of a building and the floor of another level of the building (see FIGS. 3C and 4B). Thus, the fire blocking system 27 will typically be at the top of the studs 12 and 13 (FIG. 3C) or at the bottom of the studs 12 and 13 (FIG. 4B). As discussed above, it is preferred that the thickness of the fireproof block 16 of the fire blocking system 27 be equivalent to the thickness of the slab 28 (or other structure) such that the fireproof block 16 effectively blocks the passage of smoke and fire from one part of the structure to the next (e.g., from floor to floor).

Figure 4C:
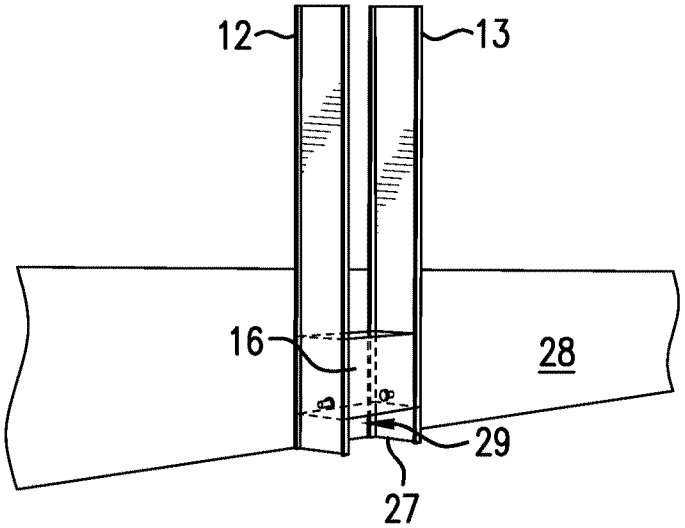

In some embodiments, the fire blocking system could be positioned at a location which is not flush with the slab or other structure. This may occur by design of the building, or because the thickness of the block 16 does not match the slab 28, or for other reasons. FIGS. 3D and 4C show examples of this type of situation. Here, there is a gap volume 29 between the studs 12 and 13 and the top or bottom of the block 16 adjacent the slab 28 (or other structure). In these cases, it is recommended that gap volume 29 be filled with mineral wool or other fire retardant materials. However, in some applications, the gap volume may not be filled with fire retardant materials, or may be filled with other materials (e.g., fire-resistant materials mixed with insulating materials, such as for example closed cell foam, or some other material which accomplishes the same purposes as those described above.

Figure 5A:
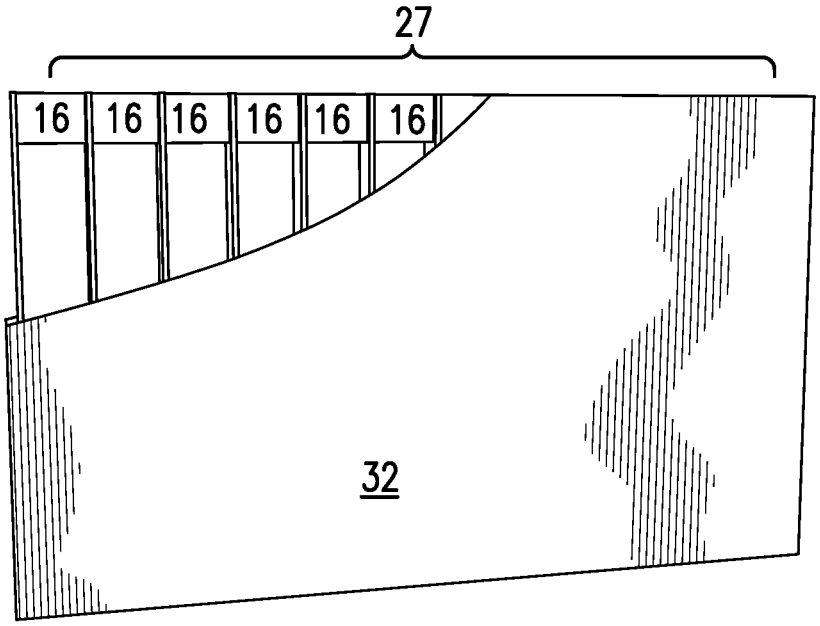
FIG. 5A-B. (A) is an isometric view of an embodiment of a building panel comprising multiple fire blocking systems, one of which is between each two adjacent studs. (B) is a perspective view of an embodiment of multiple panels positioned at different floor levels of a building.
Figure 5B:
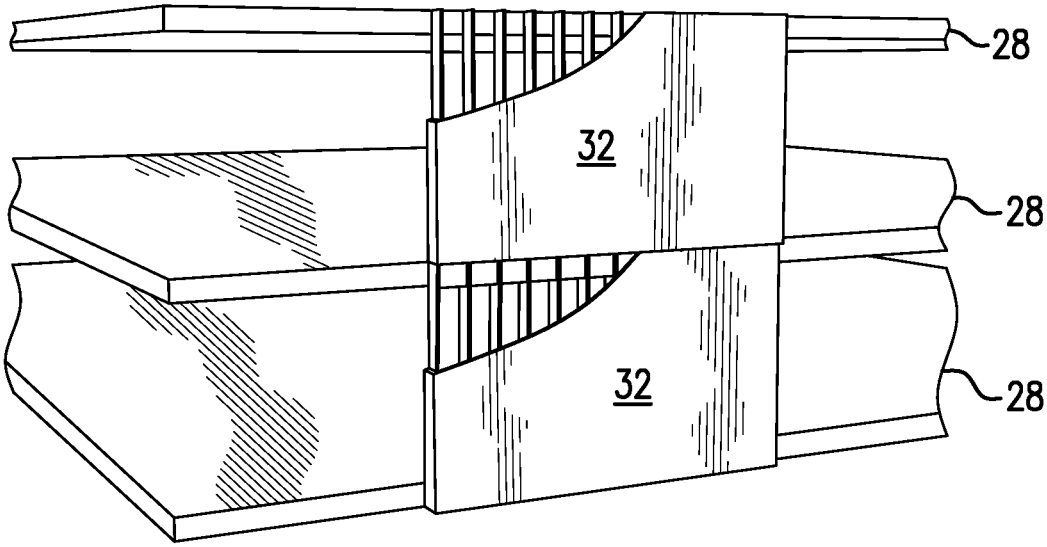

With reference to FIG. 5A it can be seen that a building panel 32 has a fire blocking system 27 between each pair of studs or beams in the panel. That is, the fireproofing block 16 may be at the top of each pair of studs, such that when the building panel 32 is positioned with the plurality of fireproofing blocks 16 adjacent a slab or other structure, the fireproofing blocks 16 will prevent the flow of smoke and fire through the building panel from one side of the slab or structure to the other. FIG. 5B shows a multilevel building where building panels 32 are stacked on top of each other for a height of the building. The panels 32 have a plurality of fire proofing systems 27 at the top and/or bottom of each pair of beams or studs in the panel. These fire proofing systems 27 prevent the flow of smoke and fire up the building from, for example, a lower unit, to a higher unit in the building. That is, since the slabs 28 are adjacent a fireproofing block 16 between each pair of studs, the fire cannot pass from one side of the slab 28 to the other through the building panel. While an exemplary application of building panels 32 is for exterior walls, especially for high-rise buildings, some panels 32 or variations thereof may also be used for other purposes including but not limited to interior walls, flooring, or roofing.

It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided it is understood that each intervening value, to the tenth of the unit of the lower limit unless the context clearly dictates otherwise, between the upper and lower limit of that range and any other stated or intervening value in that state range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely", "only" and the like in connection with the recitation of claim elements, or use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible.

While the invention has been described in terms of its preferred embodiments, those skilled in the art will recognize that the invention can be practiced with modification within the spirit and scope of the appended claims. Accordingly, the present invention should not be limited to the embodiments as described above, but should further include all modifications and equivalents thereof within the spirit and scope of the description provided herein.

What is claimed is:

1. A fire blocking or fire proofing system in a building panel, comprising:

a first fastener fastened to a first stud or beam of the building panel;

a second fastener fastened to a second stud or beam of the building panel, wherein the first and second fasteners face one another and extend respectively from the first and second studs or beams towards one another, wherein the first stud or beam and the second stud or beam are spaced from one another by a spacing separating the first stud or beam from the second stud or beam;

a monolithic block of fireproofing material having a length which spans the spacing separating the first and second studs, the monolithic block comprising an integral first slot at a first longitudinal end and an integral second slot at a second longitudinal end, the first and second slots each having an opening at a bottom of the monolithic block, wherein the monolithic block of fireproofing material is affixed to the first stud or beam and to the second stud or beam respectively by the first and second fasteners extending into the first and second slots at the first and second longitudinal ends, wherein the fireproofing material comprises a mineralized wood chip aggregate and fire resistance (FR) chemicals or compounds.

2. The fire blocking or fire proofing system of claim 1 wherein the first and second slots are each sized at a first size which is larger than the first and second fasteners at the opening at the bottom of the block, wherein each of the first and second slots narrow in a vertical direction such that a cross-sectional width of the first and second slot reduces to a second size smaller than the first size and which is equal to a size of the first and second fasteners or smaller.

3. The fire blocking or fire proofing system of claim 1, wherein the first and second slots each comprise a groove sized to fit around a head of the first and second fasteners.

4. The fire blocking or fire proofing system of claim 1, wherein the monolithic block has a width matching a width of the first and second studs.

5. The fire blocking or fire proofing system of claim 1 wherein the narrowing of said first and second slots is a taper.

6. The fire blocking or fire proofing system of claim 1 wherein a top of the monolithic block is positioned at or 0 to 18 inches below a top of the first stud or beam and a top of said second stud or beam.

7. The fire blocking or fire proofing system of claim 1 wherein the bottom of the monolithic block is positioned 0 inches to 18 inches above a bottom of the first stud or beam and a bottom of the second stud or beam.

8. A method of fire blocking or fire proofing a building structure, comprising aligning at least one building panel having a fire blocking or fire proofing system according to claim 1 such that the monolithic block of fireproofing material is adjacent to one or more slabs of the building structure, and wherein a thickness of the monolithic block of fireproofing material is the same as a thickness of a first slab of the one or more slabs.

9. The method of fire blocking or fire proofing the building structure of claim 8 wherein the at least one building panel includes two or more building panels and wherein the one or more slabs includes at least two different slabs one above another.

10. The method of fire blocking or fire proofing the building structure of claim 8 further comprising filling any volume between the first stud or beam and the second stud or beam and the monolithic block of fire proofing material which is uncovered and adjacent said one or more slabs with fire blocking materials.

11. A method of fire blocking or fireproofing a building panel for use on a structure, comprising attaching a first fastener to a first stud or beam;

attaching a second fastener to a second stud or beam, wherein the first and second fasteners face one another and extend respectively from the first and second studs or beams towards one another, wherein the first stud or beam and the second stud or beam are spaced from one another by a spacing separating the first stud or beam from the second stud or beam; and positioning a monolithic block of fireproofing material on the first and second fasteners, wherein said monolithic block has a length which spans the spacing separating the first and second studs, an integral first slot at a first longitudinal end and an integral second slot at a second longitudinal end, and the first and second slots each having an opening at a bottom of the monolithic block, and wherein the positioning is performed such that the monolithic block of fireproofing material affixed to the first stud or beam and to the second stud or beam respectively by the first and second fasteners extends into the first and second slots at the first and second longitudinal ends, wherein the fireproofing material comprises a mineralized wood chip aggregate and fire resistance (FR) chemicals or compounds.

12. The method of claim 11 wherein said step of positioning is performed by sliding or pushing the monolithic block downward on the first and second fasteners such that the first and second fasteners slide in the first and second slots, and wherein the first and second slots are tapered such that a tighter fit between the first and second fasteners and the monolithic block is achieved with increasing sliding or pushing movement.

* * * * *